United States Patent [19]

Beck

[11] Patent Number: 4,473,727

[45] Date of Patent: Sep. 25, 1984

[54] ELECTRIC SWITCH HAVING HELICAL SPRING BRIDGING ELEMENT

[76] Inventor: Wesley H. Beck, Lot 16, Shangri La Trailer Park, St. James City, Fla. 33956

[21] Appl. No.: 360,225

[22] Filed: Mar. 22, 1982

[51] Int. Cl.[3] ..... H01H 15/00

[52] U.S. Cl. ..... 200/16 A; 200/159 R; 200/276

[58] Field of Search ..... 200/16 A, 159 R, 276, 200/5 R, 5 A, 5 B, 5 C, 5 D, 5 E, 5 EA, 5 EB, 5 F, 275, 340

[56] References Cited

U.S. PATENT DOCUMENTS

| | | | |
|---|---|---|---|
| 466,644 | 1/1892 | Wollensak | 200/275 |
| 3,619,532 | 11/1971 | Lyvang | 200/275 |
| 4,028,515 | 6/1977 | Desio et al. | 200/276 |

*Primary Examiner*—Elliot A. Goldberg
*Assistant Examiner*—Morris Ginsburg

[57] ABSTRACT

This invention is directed at an electric switch which utilizes a helical spring as a bridging element. The element has each of its terminal ends in moveable engagement with a vertical channel formed in the switch housing. Special forms of fixed contacts provide means of varying the number of circuits that can be activated by the switch. The plunger may also have means of guiding the element in its movement.

6 Claims, 13 Drawing Figures

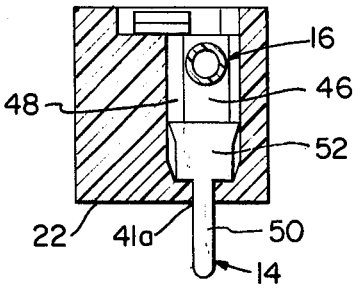
FIG. 6
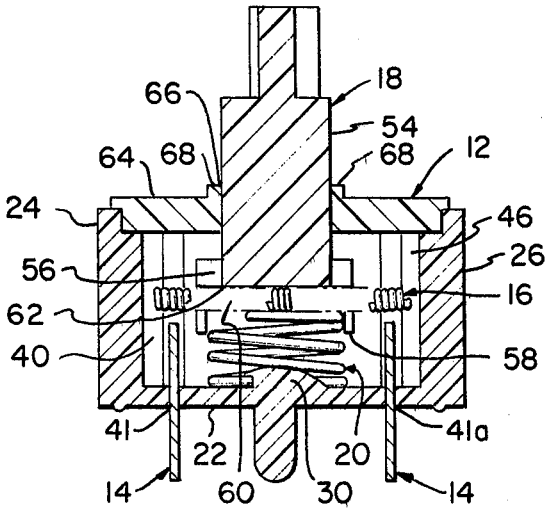
FIG. 7
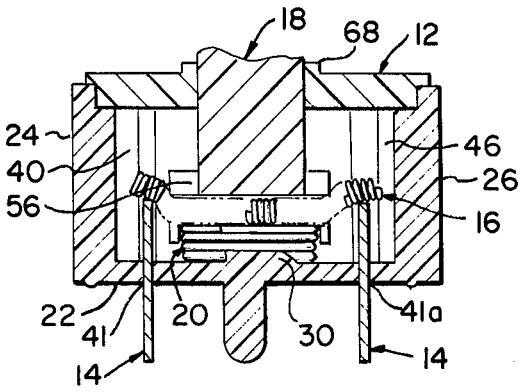
FIG. 8
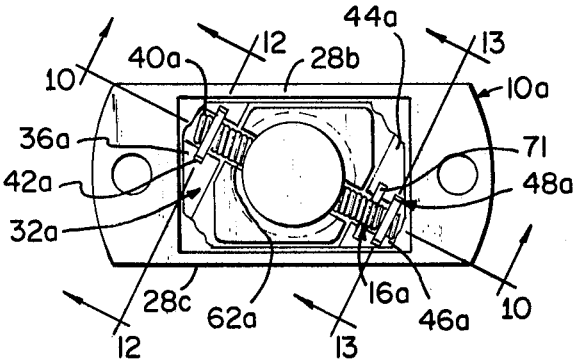
FIG. 9
FIG. 10
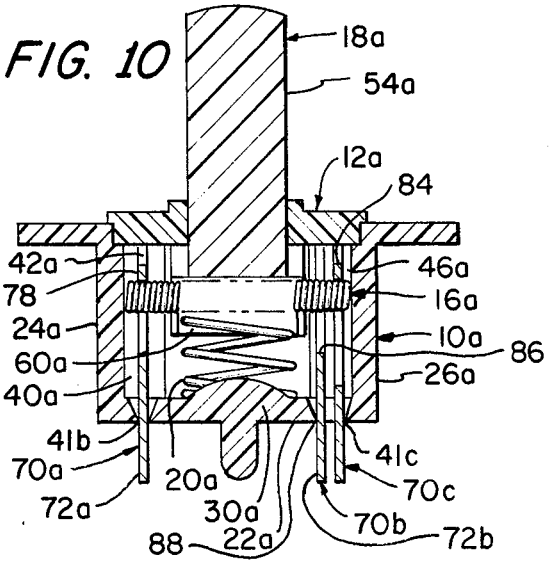
FIG. 11
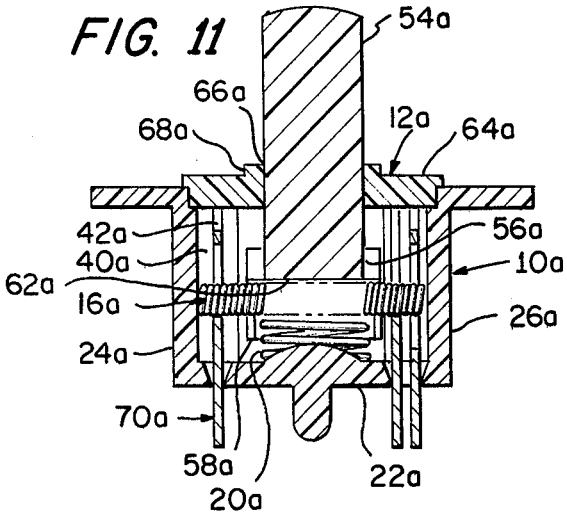

ELECTRIC SWITCH HAVING HELICAL SPRING BRIDGING ELEMENT

BACKGROUND OF THE INVENTION

This invention relates generally to switches utilizing a spring member as a bridging contact and more specifically utilizes a helical spring as a bridging contact.

The use of the two, outwardly extending, free terminal ends of a spring wire coil as a bridging contact means is disclosed in the U.S. patent to Abernethy U.S. Pat. No. 3,924,089. This reference does not utilize the action of the bending of the coil, rather it utilizes the winding up of the coil by its free end portions; furthermore, the cited patent utilizes the free end portions as contact points not portions of the coil itself as disclosed in the instant application.

SUMMARY OF THE INVENTION

The improved switch of the type disclosed herein has a tightly wound, small diameter helical spring as its moveable contact. The spring is mounted with each of its terminal ends slideably engaged within a vertical channel formed in a housing, has a plunger butted against its upper, central surface and is in superposed, abutting relation with a return spring. The switch may have two fixed contacts, extending upwardly from the base portion of the housing, which are bridged by the moveable contact. It may also have a fixed contact formed with one of the terminal ends as a rectangular frame or as a rectangular frame with one of the long sides removed providing two spaced, parallel surfaces which can be engaged mechanically and electrically by the moveable contact.

BRIEF DESCRIPTION OF THE DRAWINGS

Further details are explained below with the help of the examples illustrated in the attached drawings in which:

FIG. 6 is a section taken on line 6—6 of FIG. 5;

FIG. 7 is a section taken on line 7—7 of FIG. 5;

FIG. 8 is a section similar to FIG. 7 having the plunger depressed and the moveable contact engaged with the fixed contacts;

FIG. 9 is a top plan view of a variation of the switch shown in FIG. 1, with the cover removed;

FIG. 10 is a section taken on line 10—10 of FIG. 9 with the plunger up and the moveable contact engaged to the fixed contacts 70*a* and 70*c;*

FIG. 11 is a section similar to FIG. 10 with the plunger depressed and the moveable contact engaged with the fixed contacts 70*a* and 70*b;*

DESCRIPTION OF THE PREFFERED EMBODIMENT(S)

Figure 1:
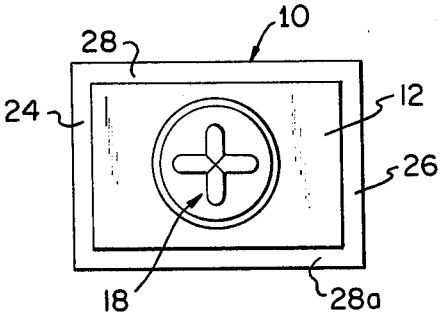
FIG. 1 is a top plan view of the switch according to the present invention.
Figure 2:
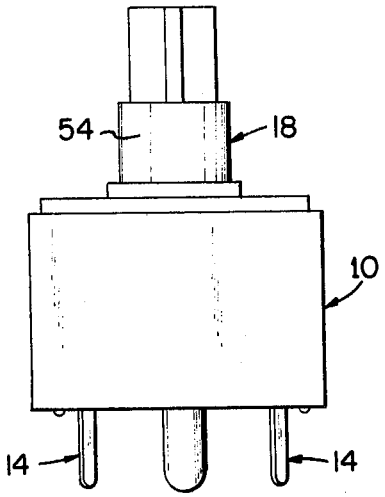
FIG. 2 is a side elevational view of the switch shown in FIG. 1.
Figure 3:
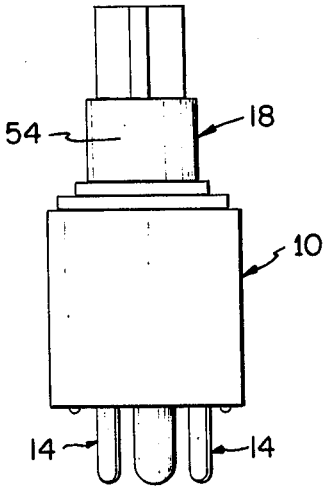
FIG. 3 is an end elevational view of the switch shown in FIG. 1.
Figure 4:
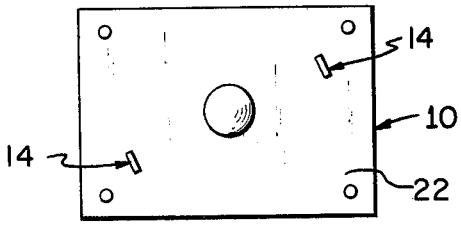
FIG. 4 is a bottom plan view of the switch shown in FIG. 1.

There is shown in the drawing an electric switch comprising a housing 10, a top plate 12, a pair of fixed contacts 14, a moveable contact 16, a plunger 18 and a return spring 20.

Figure 5:
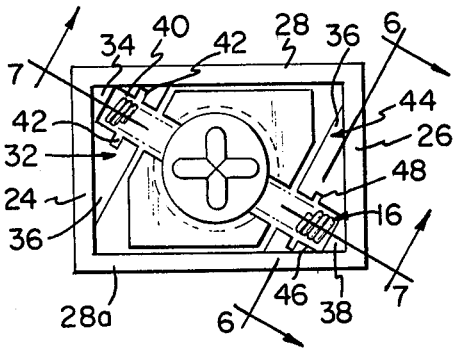
FIG. 5 is a top plan view of the switch shown in FIG. 1 with the cover removed.
Figure 12:
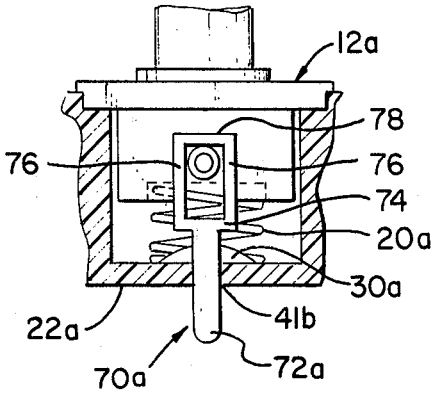
FIG. 12 is a section taken on line 12—12 of FIG. 9.
Figure 13:
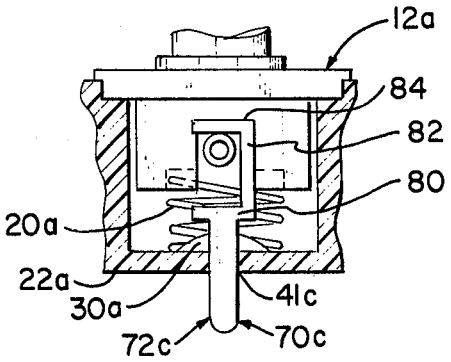
FIG. 13 is a section taken on line 13—13 of FIG. 9.

The housing 10 is formed of an electrically insulating material such as nylon and is box-like in external configuration including a rectangular base portion 22, a first wall 24 extending upwardly from a short side of the base portion 22, a second wall 26 extending upwardly from the other short side of the base portion 22 toward the same horizontal plane toward which the first wall 24 extends. A first long wall 28 extends upwardly from one long edge of the base portion 22 and a second long wall 28*a* extends upwardly from the other long edge of the base portion 22 connecting the first and second walls 24, 26 as shown in FIG. 5. The first and second walls 24, 26 are in spaced, parallel relation to each other and the first and second long walls 28, 28*a* are in spaced parallel relation to each other. A dome-like protuberance 30 is centrally positioned on the inner surface of the base portion 22 extending upwardly into the cavity of the housing 10 for a purpose to be described hereinafter. A first triangular support portion 32 is in integral relation with the majority of the inner surface of the first wall 24 and a comparatively small portion of the inner surface of the first long wall 28. The abutment line of the first wall 24 and the first long wall 28 defines the first internal angle 34 as shown in FIG. 5. In effect, the first support portion 32 fills the first internal angle 34.

The first support portion 32 is brought to 0.080 inches of the open top of the housing 10 providing a portion of the shelf surface 36 whose purpose will be explained hereinafter. A free surface of the first portion 32 faces the cavity of the housing 10 and the second internal angle 38 defined by the abutment of the second wall 26 and the second long wall 28*a*. A substantially rectangular, vertical first channel 40 is formed, in the first support portion 32, extending from through the shelf surface 36 to the plane of the inner surface of the base portion 22 at which plane the walls of the first channel 40 angle inwardly to a triangular configuration truncated at the external surface of the base portion 22 and leading into a first aperture 41 formed through the base portion 22. A rectangular groove is formed in each of the facing walls of the first channel 40, extending vertically from the inner surface of the base portion 22 through the shelf surface 36 in opposed relation to each other and both opening into the first channel 40 to form a first groove pair 42. The mid point of the grooves of the groove pair 42 are aligned with the first aperture 41.

A second support portion 44 is integral with the majority of the inner surface of the second wall 26 and of a comparatively small portion of the inner surface of the second long wall 28*a*. The second support portion 44 fills the second internal angle 38 and is brought to 0.080 inches of the open top of the housing 10 to provide another portion of the shelf surface 36. A second channel 46 is formed in the second support portion 44 similar in configuration and dimensions to the first channel 40 including a triangular lead into second aperture 41*a* and a second groove pair 48 whose position in relation to the second channel 46 is similar to the relation of the first aperture 41 and the first groove pair 42 to the first channel 40.

The fixed contacts 14 are formed from a conductive material such as steel, are each paddle-like in configuration, and each comprises a comparatively narrow, flat, rectangular shank portion 50 integral with and extending from the midpoint of the edge of a rectangular blade portion 52 providing a shoulder with the blade portion 52 on each long side of the shank portion as shown in FIG. 6. The shank portion 50 and the blade portion 52 lie on the same horizontal plane. The fixed contacts 14 are assembled with the housing 10 by passing a fixed contact 14 into each of the channels 40, 46. For example, a fixed contact 14 is passed into the first channel 40 with its shank portion 50 directed at the base portion 22 and a side edge of the blade portion 52 riding in one of the grooves of the first groove pair 42 and the other side edge of the blade portion 52 riding in the other groove of the first groove pair 42. The fixed contact 14 is pressed toward the base portion 22 until the shank portion 50 passes through the first aperture 41 and the shoulders of the fixed contact 14 bear against the inner surface of the base portion 22.

The moveable contact 16 comprises a helical spring formed of an electrically conductive material, for example, phosphor bronze, having a length of 0.545 inches and an O.D. of 0.085 inches.

The return spring 20 is of the helical type, formed of music wire, having a length of 0.225 inches and an O.D. of 0.285 inches. One end of the return spring 20 is butted against the inner surface of the base portion 22 and circumscribes the protuberance 30.

One of the free terminal ends of the moveable contact 16 rides in the first channel 40 while the other rides in the second channel 46, at the same time the moveable contact 16 is centrally supported by the free end of the return spring 20 positioning the moveable contact 16 in spaced relation to the blade portions 52 of the first contacts 14.

The plunger 18 comprises a cylindrical rod portion 54 integral with and extending at right angles from the upper surface of a platform portion 56. The plunger 18 is formed an insulating material such as an acetal resin. The platform portion 56 has an external configuration which in some ways resembles a parallelogram with a thickness of 0.225 inches and a bottom surface 58 which includes a generally circular depression 60. A slot 62 is formed through the bottom surface 58 and the depression 60 to the bottom of the rod portion 54. The top plate 12 includes a rectangular base 64 having a centrally located, circular, through aperture 66 formed therein. A tubular portion 68 extends from the upper surface of the base 64 in coaxial relation to the aperture 66 as indicated in FIGS. 7 and 8.

The plunger 18 is assembled within the housing 10 by positioning the slot 62 so that the central portion of the length of the moveable contact 16 is within the slot 62 and butted against the surface of the rod portion 54 which formed a side of the slot 62. One of the external side walls of the platform portion 56 is in butting, sliding engagement with the internal surface of the first long wall 28 while the other external side wall has a similar engagement with the second long wall **28*a* of the housing 10. The inner surface of the wall defining the circular depression 60 of the platform portion 56 circumscribes the "free" end of the return spring 20. The rod portion 54 of the plunger 18 is passed through the aperture 66 of the top plate 12 with the free terminal end of the rod portion 54 extending beyond the top plate as shown in FIG. 7. As shown in FIGS. 7 & 8, the center portion of the moveable contact 16 is positioned within the area defined by the slot 62. The base 64 of the top plate 12 is positioned in superposed abutting relation with the shelf surfaces 36 of the first and second support portions 32, 44 of the housing 10. The base portion 64 is adhered or otherwise attached to the shelf surfaces 36**.

To operate the switch, the plunger 18 is depressed thereby urging the moveable contact 16 toward the fixed contacts 14 and depressing the return spring 20. The free ends of the moveable contact 16 descend within the first and second channels 40, 46 until they butt against the fixed contacts 14. The moveable contact 16 can now operate as a shorting bar. Since the moveable contact 16 is a helical spring, continued depression of the plunger 18 after engagement of the fixed contacts 14 will cause the center portion of the moveable contact to bend as shown in FIG. 8 providing a take-up for over-travel. To break the contact, the pressure on the plunger 18 is released thereby permitting the bowed return spring 20 to drive the plunger 18 and the moveable contact 16 back to their original, at rest, positions.

A variation of the switch, disclosed above, is shown in FIGS. 9–13 of the drawings. The variation is shown as a single-pole, double-throw two circuit switch and includes a housing **10*a* similar, in most respects, to the housing 10, a top plate 12*a*, a moveable contact 16*a* similar to the moveable contact 16, a plunger 18*a* similar in many respects to the plunger 18 and a return spring 20*a* similar to the return spring 20. The variation differs in a substantial way from the original in the number and configuration of the fixed contacts and in the utilization of two pair of grooves opening into one of the vertical channels in one of the support portions. The variation has three fixed contacts 70*a*, 70*b* and 70*c***.

The housing **10*a* has the same box-like configuration as the housing 10 including a base portion 22*a*, a first wall, a second wall, first long wall and second long wall 24*a*, 26*a*, 28*b* and 28*c* respectively. Triangular first and second support portions 32*a*, 44*a* are formed in the housing 10*a* and are positioned in the same way as the first and second support portions 32, 44. A first channel 40*a* is formed in the first support portion 32*a* and a second channel 46*a* is formed in the second support portion 44*a*. The first channel 40*a* is identical in position and configuration to the first channel 40 including having a first aperture 41*b* and a first groove pair 42*a* opening into it. The second channel 46*a* is substantially rectangular in configuration extending from through the shelf surface 36*a* to the plane of the inner surface of the base portion 22*a*. The second channel 46*a* angles inwardly to a triangular configuration truncated at the external surface of the base portion 22*a* and leading into a second aperture 41*c* which is formed through the base portion 22*a*. A rectangular groove is formed in each of the facing walls of the second channel 46*a*, extending vertically from the inner surface of the base portion 22*a* through the shelf surface 36*a* in opposed relation to each other and both opening into the second channel 46*a* to form a second groove pair 48*a*. A third groove pair 71 is also formed, in a similar manner, in the facing walls of the second channel 46*a* which is in spaced parallel relation to the second groove pair 48*a* and which is closer to the vertical axis of the housing 10*a* than the second groove pair 48*a*. A protuberance 30*a* having a similar configuration and position as the protuberance 30 extends upwardly from the base portion 22*a***.

The fixed contact **70*a* comprises a comparatively narrow, flat, thin rectangular terminal portion 72*a* integral with and extending from the center of the platform part 74 of an open frame member. The platform portion 74 includes terminal ends each having an arm 76 extending upwardly therefrom at right angles to the horizontal plane of the platform part 74 and in spaced parallel relation to each other. Each of the arms 76 has a terminal end remote from the platform part 74 connected by a cap portion 78** completing the frame.

The fixed contact 70c comprises a comparatively narrow, flat, thin, rectangular terminal portion 72c integral with and extending from an engagement portion. The engagement portion includes a horizontal narrow, thin, flat first leg 80 having a terminal end from which an integral connector portion 82 extends and which in turn has a terminal end integral with a second leg 84. The second leg 84 extends from the connector portion 82 and is in spaced, parallel relation with the first leg 80.

The fixed contact 70b is simply an elongated terminal portion 72b having the same configuration as the terminal portions 72a and 72c. One of the free ends 86 of the fixed contact 70b is used as a contact surface as will be more fully explained hereinafter.

The fixed contact 70a is assembled with the housing 10a by passing it into the first channel 40a and the contacts 70b and 70c are assembled in the second channel 46a. The contact 70a is passed into the first channel 40a with its terminal portion 72a directed at the base portion 22a and one of its arms 76 riding in one of the grooves of the first groove pair 42a and its other arm 76 riding in the other groove of the first groove pair 42a. The contact 70a is pressed toward the base portion 22a until the terminal portion 72a passes through the first aperture 41b and the lower edge of the platform part 74 bears against the inner surface of the base portion 22a. The contact 70c is assembled with the housing 10a by passing it into the second channel 46a with its terminal portion 72c directed at the base portion 22a and the edge of the connector portion 82 riding in one of the grooves of the second groove pair 48a and the terminal ends of the first and second legs 80, 84 riding in the other groove of the second groove pair 48a. The contact 70c is urged toward the base portion 22a until the terminal portion 72c passes through the second aperture 41c and the shoulders formed by the terminal portion 72c and the first leg 80 abut the inner surface of the base portion 22a. The contact 70b is assembled with the housing 10a by directing its terminal portion 72b toward the third aperture 88 and sliding the contact's 70b long side edges into and along the third groove pair 71. The terminal portion 72b is passed through the aperture 88 until the free end 86 is positioned on the same horizontal plane as that on which the upper edge of the platform part 74 of the contact 70a is located.

One end of the return spring 20a bears against the inner surface of the base portion 22a in circumscribing relation to the protuberance 30a. One of the free ends of the moveable contact 16a rides in the first channel 40a while the other end rides in the second channel 46a. The moveable contact 16a is centrally supported by the free end of the return spring 20a which, through the action of the plunger 18a, as will be explained hereinafter, urges one terminal portion of the moveable contact 16a against the inner edge of the cap portion 78 of the contact 70a and simultaneously urges the other terminal portion against the inner edge of the second leg 84 of the contact 70c.

The plunger 18a includes a rod portion 54a, and a platform portion 56a having the same configuration and relation to each other as the rod portion 54 and the platform portion 56. The platform portion 56a has a bottom surface 58a including a depression 60a and a slot 62a all similar in every respect to the same parts described herein for the plunger 18.

The top plate 12a includes a rectangular base 64a having a centrally located circular, through aperture 66a formed therein. A tubular portion 68a extends from the upper surface of the base 64a in coaxial relation to the aperture 66a as indicated in FIGS. 10 & 11.

The plunger 18a is assembled within the housing 10a by positioning the slot 62a so that the central portion of the length of the moveable contact 16a is within the slot 62a and butted against the surface of the rod portion 54a which forms a side of the slot 62a. One of the external side walls of the platform portion 56a is in butting sliding engagement with the internal surface of the first long wall 28b while the other external side wall has a similar engagement with the second long wall 28c of the housing 10a. The inner surface of the wall defining the circular depression 60a of the platform portion 56a circumscribes the "free" end of the return spring 20a. The rod portion 54a of the plunger 18a is passed through the aperture 66a of the top plate 12a with the free terminal end of the rod portion 54a extending beyond the top plate 12a, as shown in FIGS. 10 and 11. The base 64a of the top plate 12a is positioned in superposed abutting relation with the shelf surfaces 36a of the first and second support portions 32a, 44a of the housing 10a. The base portion 64a is adhered or otherwise attached to the shelf surfaces 36a.

With the plunger 18a fully elevated, the moveable contact 16a is engaged with the second leg 84 of contact 70c and with the cap portion 78 of the contact 70a providing an electrical connection therebetween which may complete a first electrical circuit (not shown). If the plunger 18a is depressed, the moveable contact 16a is urged toward the inner edge of the platform part 74 of the contact 70a and the free end of the contact 70b. The free ends of the moveable contact 16a descend within the first and second channels 40a, 46a until they abut the platform part 74 and the free end 86. At this time, the moveable contact 16a acts as a shorting bar between the contacts 70a and 70b completing what may be a second electrical circuit (not shown). Obviously, the moveable contact 16a can provide take-up for overtravel as disclosed herein for the moveable contact 16. To disengage the second electrical circuit, pressure on the plunger 18a is released permitting the compressed return spring 20a to impel the plunger 18a and the moveable contact 16a back to their original positions.

What I claim is:

1. An electric switch including a housing, a first pair of fixed contacts, a moveable contact, a plunger, and a return spring, the housing having a cavity, a central vertical axis, and a base portion, the plunger moveably associated with the housing and having an engagement surface, the fixed contacts engaged to the housing, extending into the housing and spaced from each other, the return spring having a first and a second end and positioned within the cavity, the first end of the return spring in superposed relation to the base portion, the moveable contact comprising a helical spring positioned in the housing in angular relation to the central vertical axis of the housing and in superposed relation to the return spring and to the fixed contacts, the engagement surface of the plunger being in superposed relation to the moveable contact whereby depressing the plunger urges the moveable contact against the return spring, compressing the return spring and permitting the moveable contact to make bridging electrical engagement with the first pair of fixed contacts.

2. An electric switch according to claim 1 wherein the housing includes opposite sides and a vertical channel formed on each of the opposite sides and opening into the cavity, the moveable contact having a first free terminal end and a second free terminal end, the first free terminal end of the movable contact positioned in one vertical channel and the second free therminal end positioned in the other vertical channel.

3. An electric switch according to claim 2 wherein each of the vertical channels extends to the base portion and one of the fixed contacts is positioned in each of the vertical channels and the fixed contacts.

4. An electric switch according to claim 2 wherein the housing is rectangular in configuration and includes diagonally opposed inner corners, a vertical slot being positioned in close proximity to each of the inner corners.

5. An electric switch according to claim 1 wherein the plunger comprises a rod portion and a platform portion, an engagement surface formed on the rod portion and the platform portion extending from the rod portion and having a horizontal channel formed therein, the horizontal channel including the engagement surface.

6. An electric switch including a housing, first, second and third fixed contacts, a moveable contact, a plunger, and a return spring, the housing having a cavity, a central vertical axis, and a base portion, the plunger moveably associated with the housing and having an engagement surface, the first fixed contact having a frame portion, the frame portion including a platform portion and a cap portion, the platform and cap portions in spaced, parallel relation to each other, the first fixed contact engaged to the housing whereby the frame portion is positioned within the cavity of the housing, the second fixed contact having a free end, being engaged to the housing and being spaced from the first fixed contact whereby the free end is positioned within the cavity of the housing, the third fixed contact having a first leg including a terminal end from which a connector portion integrally extends at right angles to the first leg and a second leg extending integrally from the connector portion in spaced, parallel relation to the first leg, the third fixed contact being engaged with the housing whereby the first leg, second leg and connector portion are positioned within the cavity of the housing, the cap portion of the first fixed contact and the second leg of the third fixed contact lying on the same horizontal plane, the third fixed contact being spaced from the first and second fixed contacts, the free end of the second fixed contact and the platform portion of the first fixed contact lying on the same horizontal plane within the cavity, the return spring having a first and a second end, the first end of the return spring in superposed relation to the base portion, the moveable contact comprising a helical spring positioned in the housing in angular relation to the central vertical axis of the housing, under both the cap portion of the first fixed contact and the second leg of the third fixed contact and in superposed relation to the return spring, to the platform portion of the first fixed contact, to the free end of the second fixed contact, and to the first leg of the third fixed contact, the engagement surface of the plunger in superposed relation to the moveable contact whereby depressing the plunger urges the movable contact away from the cap portion and the second leg and against the return spring, compressing the return spring and permitting the moveable contact to make bridging electrical engagement with the platform portion of the first fixed contact and the free end of the second fixed contact.

* * * * *